United States Patent [19]

Mamo

[11] 4,122,821

[45] Oct. 31, 1978

[54] ARCHERY BOW AND METHOD OF ADVANTAGEOUSLY ALTERING BOW CHARACTERISTICS

[76] Inventor: Anthony C. Mamo, 1515 E. Central Ave., Apt. 264B, Arlington Heights, Ill. 60005

[21] Appl. No.: 755,972

[22] Filed: Dec. 30, 1976

[51] Int. Cl.[2] ..... F41B 5/00

[52] U.S. Cl. ..... 124/23 R

[58] Field of Search ..... 124/23 R, 24 R, 88, 124/86, 41 A, 25; 273/80 C, 80 F, 80 H, 80 R, 80.6, 80.9; 43/18 GF, 18 R

[56] References Cited

U.S. PATENT DOCUMENTS

| | | | |
|---|---|---|---|
| 1,724,387 | 8/1929 | Wilcox | 124/23 R |
| 1,928,009 | 9/1933 | Dornier | 273/80 B |

FOREIGN PATENT DOCUMENTS

| | | | |
|---|---|---|---|
| 1,049,274 | 1/1959 | Fed. Rep. of Germany | 124/23 R |

*Primary Examiner*—Richard C. Pinkham

*Assistant Examiner*—William R. Browne

[57] ABSTRACT

An archery bow in which there are limbs outwardly extending from a center grip portion, and the cross-sections of the limbs at points along the longitudinal axis of the limbs are of predetermined curved configuration such that on drawing of the bow and decreasing of the radius of curvature of the longitudinal axis of the bow, there will occur at a predetermined rate, increase in the radii of cross-sectional curvature of the limbs. Each bow limb structure has cross-sectional configurations that are curved in its transverse planes which are substantially perpendicular to its longitudinal axis. The configurations have predetermined dimensions of thickness and predetermined dimensions of extent of curvature which progressively vary at different sections of the limb structure. With increase of draw of the limb structures the radius of longitudinal curvature decreases while the radius of curvature of each configuration increases progressively and at different rates at different sections.

5 Claims, 19 Drawing Figures

FIG. 2
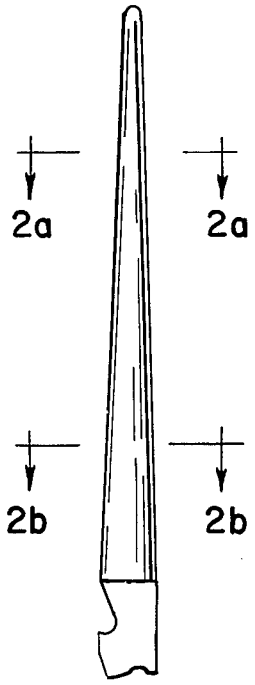
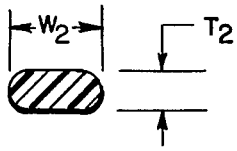
FIG. 2b
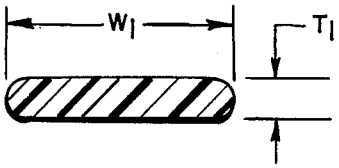
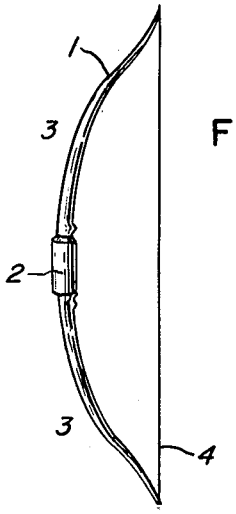
FIG. 1
FIG. 8
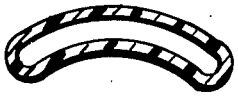
FIG. 9
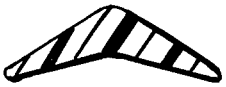

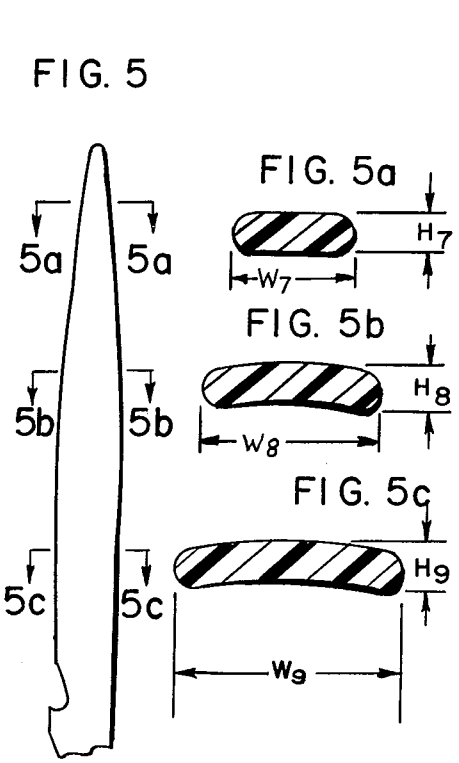
FIG. 5
5a
5b
5c
FIG. 5a
H7
W7
FIG. 5b
H8
W8
FIG. 5c
H9
W9
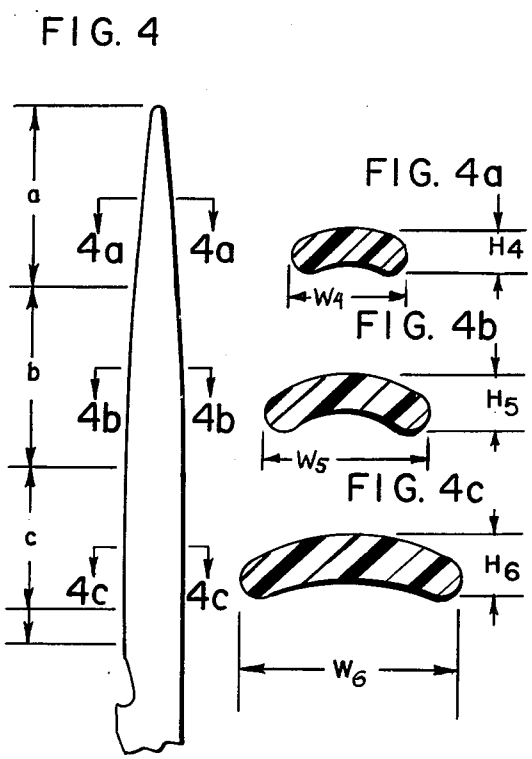
FIG. 4
a
b
c
4a
4b
4c
FIG. 4a
H4
W4
FIG. 4b
H5
W5
FIG. 4c
H6
W6
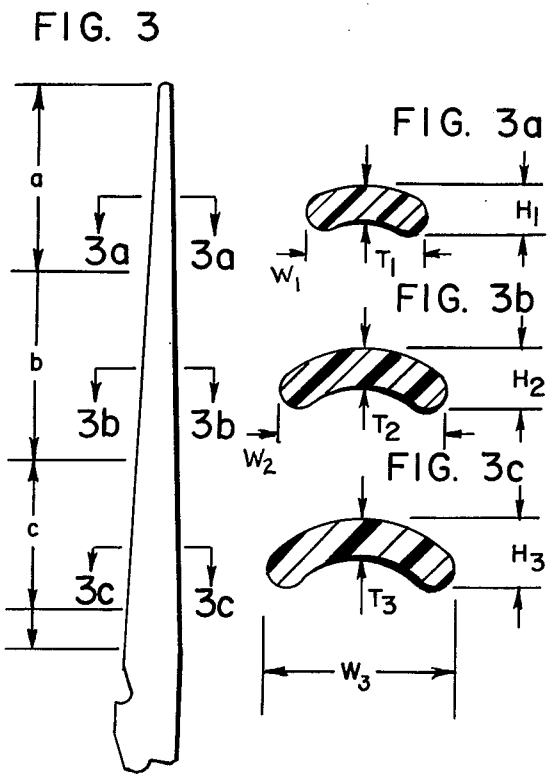
FIG. 3
a
b
c
3a
3b
3c
FIG. 3a
H1
T1
W1
FIG. 3b
H2
T2
W2
FIG. 3c
H3
T3
W3

ARCHERY BOW AND METHOD OF ADVANTAGEOUSLY ALTERING BOW CHARACTERISTICS

The present invention relates to an improved construction of an archery bow or like device having controlled operational characteristics and to the method for making the same.

Conventional archery bows of good quality possess essentially straight-line draw characteristics in that the force exerted in drawing back the bowstring is essentially proportional to draw length and the energy which will be imparted to the arrow upon release of the bowstring is proportional to the area under the force-draw curve, less that amount of energy that goes back into all of the moving parts of the bow.

In a conventional bow construction, in order to impart greater energy to the arrow upon release of the bowstring, one draws back the arrow a greater distance. The length of the draw, however, is limited to anatomical characteristics and the physical strength of the archer.

The nature of the bow and particularly the rigidity of the bow and the force required for the drawing thereof is the primary determinant with respect to energy imparted to the arrow. Bows are, therefore, rated or graded according to the number of pounds of force required to pull the bow to a fully drawn position.

Archery bows are manufactured in various sizes, and in accordance with various specifications such as draw lengths, and draw forces. The basis of selection of any particular bow is determined by the strength and size of the archer, having particular regard to arm length.

A major disadvantage inherent in the conventional archery bow is that particular characteristic which requires the aiming of the bow to be accomplished while the bow is exerting maximum resistance, and requiring maximum pull effort on the part of the archer. This makes effective aiming very difficult.

Attempts have been made to vary the characteristics of the bow to decrease the draw resistance during the condition at which aiming takes place. Success has been achieved in this regard at the expense of size, weight, cost and efficiency through the use of compound bows having pulley arrangements and other means through which the highest draw resistance occurs at some early stage of the entire draw cycle. That is to say, maximum pull force is encountered before full draw position is reached, and as the drawing of the bow continues, the force or effort required while approaching full draw condition diminishes and becomes less than the maximum. The advantage of this arrangement is that the archer, when drawing the bow, can use a "jerk" action or a short-duration, high-effort impulse tug, to draw the bow over and beyond the maximum force point, beyond which a reduced amount of force is required to maintain the bow in full draw position, which position may be maintained without discomfort to the archer for a period of time required for effective aiming.

Compounds bows have the disadvantage of greatly adding to the weight of the bow structure. In typical cases, the weight of the compound bow is approximately double the weight of a conventional bow. Further, the compound bow has the disadvantage of greatly increased cost. Compound bows usually utilize four or more steel cables and a number of comparatively heavy hinges and pulleys which add to the total and moving mass of the bow structure. This increased moving mass reduces the efficiency of the bow. Only a portion of the energy stored in the drawn bow is imparted to the arrow, because a significant portion of that energy must be imparted to the much greater moving mass of the compound bow. As a consequence, compound bows will usually have mechanical advantage improvements of only 10 to 15 percent more than that achieved in a conventional bow structure.

The present invention can provide approximately double the arrow energy of a conventional bow of comparable draw force, and enables the utilization of a lighter bow construction, rather than a heavier bow construction, to achieve the desired results without the use of pulleys, hinges and multiple cables.

The design of the archery bow in the present invention is one that requires no extra mass to be added to the body of the bow of the prior art and in normal circumstances, the actual mass may be reduced below that of bows of conventional design having the same power. There is a reduction of mass approximately 50% below that of the compound bow. The conventional bow has essentially a rectangular cross-section and is curved in a longitudinal plane and increasing the draw length produces a decrease in its radius of longitudinal curvature. The improved archery bow of the present invention has a simultaneous curvature in at least two transverse planes with the consequence that increase in bow draw distance produces a decrease in the longitudinal curvature of the bow and a simultaneous increase in the radius of cross-sectional curvature thereof. That is to say, the limb of the bow has a particular cross-sectional curvature along its length. As the bow is drawn, it becomes "more curved" and less straight with respect to its longitudinal axis, while the cross-sections of the limb become "less curved" and more flat.

For a principal object, this invention aims to provide an improved archery bow having a limb structure with controlled operational characteristics as well as a method for making the same. Also, an object is to provide an improved limb structure having a cross-sectional configuration that is simultaneously curved in at least two transverse planes and the extent of curvature of the cross-sectional configuration varying progressively with bow draw distance at different sections of the limb structure.

The concept of the bow design of the present invention is applicable to any type of basic archery bow forms or configurations.

A further explanation of the details of the present invention will be made in conjunction with the attached drawings wherein:

FIG. 1 represents an archery bow of the present invention;

FIG. 2 shows a portion of a frontal view of a typical bow of the prior art;

FIGS. 2*a* and 2*b* indicate the cross-sectional configuration of the conventional bow at sections 2*a*—2*a* and 2*b*—2*b* along the length of the limb of the bow;

FIG. 3 shows a portion of a frontal view of a bow of the present invention, the bow being strung, but at rest;

FIGS. 3*a*, 3*b* and 3*c* show cross-sectional configurations at section lines 3*a*—3*a*, 3*b*—3*b*, and 3*c*—3*c* along the length of the limb as shown in FIG. 3;

FIG. 4 shows a portion of the frontal view of a bow of the present invention in which the bow is in approximate mid-draw condition of the bow.

Figure 7:
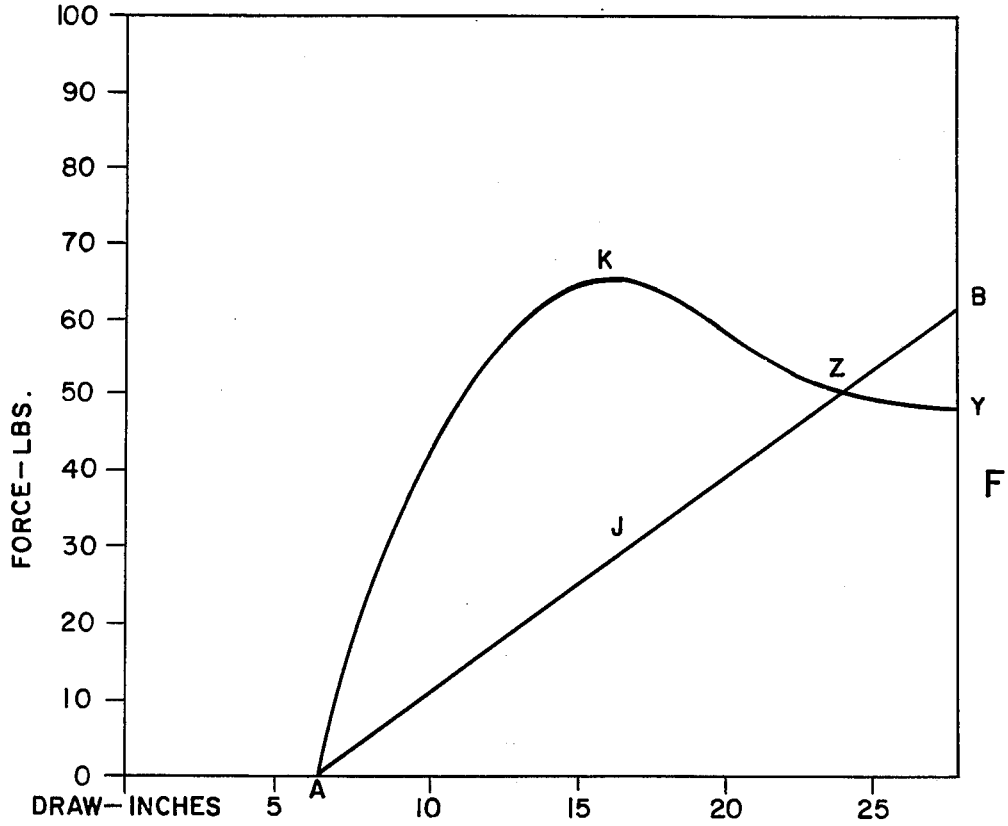
Figure 6:
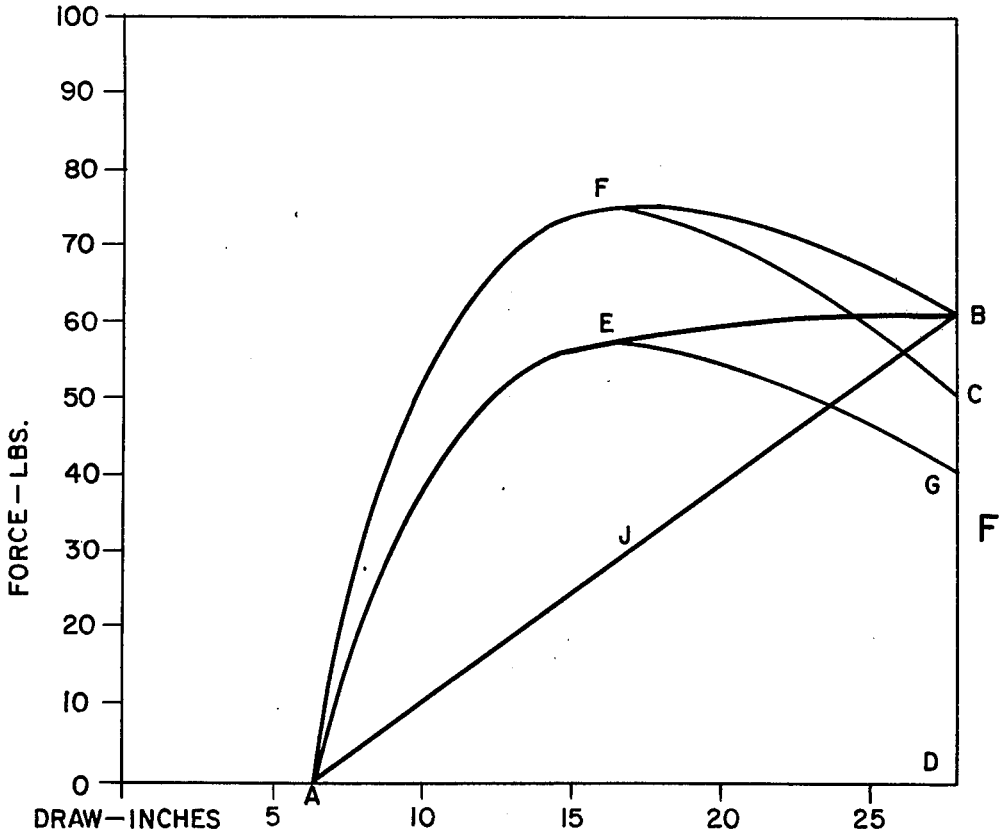

FIGS. 4*a*, 4*b* and 4*c* represent cross-sectional configurations taken along section lines 4*a*—4*a*, 4*b*—4*b*, and 4*c*—4*c* along the limb of the bow section shown in FIG. 4 which shows the bow in mid-drawn condition; FIG. 5 shows a portion of the frontal view of the bow of the present invention in which the bow is in approximate full draw condition;

FIGS. 5*a*, 5*b*, and 5*c* represent cross-sectional configurations taken along section lines 5*a*—5*a*, 5*b*—5*b*, and 5*c*—5*c* along the limb of the bow section shown in FIG. 5 which shows the bow in approximate full drawn condition;

FIG. 6 represents curves showing a comparison of the characteristics of bows of the conventional prior art, as compared to bow constructions embodying the principles of the present invention and illustrating variations obtainable through design selection; and FIG. 7 is another curve illustrating certain desirable draw characteristics of a bow embodying the teachings of the present invention as compared to force-draw variations of prior art bow construction.

FIG. 8 is a typical cross-section of a bow of the present invention illustrating a hollow construction.

FIG. 9 is a cross-section of a bow of the present invention wherein flat sided design is employed, the curved portions of the cross-section existing only at the apexes or corners of the flat sides.

The principle of the present invention may be applied to any of the known forms of bow configurations, that is, the straight limb bow, or the curved bow, or the re-curved design of bow.

As in prior art bows, the present invention includes a central grip portion 2, a longitudinally curved body member 1, with two outwardly extending limbs 3. When the limbs are flexed, the outer ends are moved closer together while the limb sides move further apart, and a conventional bow flexible string 4 is attached to and interconnects the outer ends of the limbs 3. This represents the strung condition of the bow.

The essential characteristic of the present invention resides in the fact that the bow limbs 3 are constructed such that they have cross-sectional configurations that are not rectilinear, but are curved in a particular manner. The cross-sectional configuration has predetermined dimensions of thickness T, extent of curvature H and width W that vary progressively and at a different rate at different sections of the bow limbs in conformity with a pull force-draw distance curve characteristic. Varying characteristics can be obtained in the force versus draw curve relationship by particular design of the cross-sectional curvature at each section of the bow limbs. This design concept is based on the systematic assignment and progressive variation of predetermined dimensions of the thickness of the material at the cross-section of the bow limbs, the extent of curvature and width therein. Different dimensions of T and H are assigned to particular sections of the limbs such that as the bow is drawn, the longitudinal curvature of the limbs decreases while the simultaneous curvature of the cross-sectional configuration thereof increases and flattens at a progressive rate.

The present invention contemplates a method for design and construction of an archery bow wherein drawing of the bow will cause a changing from curved cross-section to nearly rectangular cross-section at all or different parts of the bow in response to different stages of draw. Having regard to the central grip portion of the bow and considering the fact that each limb has a proximal section, a mid-section and a distal section, the flattening or changing from curved cross-section to nearly rectangular cross-section may be design choice occur at any one of these sections and at any preselected order.

In the practice of the invention a preferred method of making the bow may include the following steps: selecting a configuration for a bow limb cross-section, systematically selecting and assigning predetermined dimensions of thickness T, extent of curvature H and width W to the cross-sectional configuration at different sections of the limb and forming the bow limb to the particularly curved cross-section configuration having the predetermined dimensions of thickness T, extent of curvature H and width W, that vary progressively at different sections of the bow limb such that a desired energy curve characteristic is produced on the force-draw chart.

Having regard to FIG. 1 of the drawings, there is shown a typical bow in strung condition and being at-rest or at a condition of zero-draw length.

The prior art construction shown in FIG. 2 has a cross-sectional area of the bow limb which is essentially rectangular, and remains essentially rectangular irrespective of the degree or stage of draw of the bow, and also bow width does not change with draw length.

FIG. 3 of the drawings illustrates an embodiment of the present invention at a condition of the bow as shown in FIG. 1, that is, the bow being strung, but without draw. For convenience, cross-sections 3*a*, 3*b* and 3*c* illustrate the configuration of the cross-sectional areas at various sections of the bow limb. For convenience, reference is made to three general sections A, B and C of the limb representing respectively the distal end, the midsection, and the proximal section of the limb. The degree of cross-sectional curvature of the bow at each section is curved to an extent determined by design. The actual thickness of the bow material, relating to the limb structure cross-section is represented by $T_1$, $T_2$ and $T_3$. The extent of curvature is represented by the dimensions $H_1$, $H_2$ and $H_3$. The width of the bow at each section is represented by dimensions $W_1$, $W_2$ and $W_3$.

FIG. 4, along with sectional views 4*a*, 4*b* and 4*c* correspond to the same respective views as FIGS. 3*a*, 3*b* and 3*c* but illustrate the flattening or diminishing of dimensions $H_1$, $H_2$, $H_3$ or flattening of cross-sectional curvature that occurs as the bow is drawn.

In the particular design of the bow depicted in this figure, the characteristic is such that at approximate mid-draw condition, there occurs a nearly full flattening of the curved cross-section of the bow at section C, while the cross-sectional curvatures at sections A and B are not yet approaching flatness, $H_4$, $H_5$ and $H_6$ are less than $H_1$, $H_2$ and $H_3$ respectively.

In FIG. 5, which represents this particular bow at full draw condition, cross-sections at sections B and C are now also shown to approach flatness; that is, FIGS. 5*a*, 5*b* and 5*c* all indicate that the curvature of the cross-section has flattened in all parts of the limb, $H_7$, $H_8$ and $H_9$ are least and nearly equal to $T_7$, $T_8$ and $T_9$, respectively.

For any given thickness T, and for any given homogeneous material of which the bow of the present invention is constructed, the stiffness of the bow limb may be intensified or controlled in design of the bow by selecting the dimension H to equal or nearly equal the thickness dimension T in one or more of the sections A, B or C as full draw condition is approached. The degree of curvature shown by the dimension H may be different for each section of the bow as illustrated in cross-section views 3*a*, 3*b* and 3*c*. The degree of curvature selected by design, can be such that as the bow approaches full draw condition, the dimension H will approach the dimension T, and the design can be such that this will first occur at section A, or at section B, or at section C, or combinations thereof, depending upon the characteristic curve sought to be attained.

The design selection of the arcuate curvature of cross-section of the bow can be such that the dimension H will approach dimension T progressively from section C to section B to section A, or vice versa, or from section B to section C and A simultaneously, or from sections C and A simultaneously inward toward section B.

The present invention is based upon a concept that Hooke's Law (in an elastic material, strain is proportional to stress) will not apply where the modulus of rigidity is not constant, and in the present invention, such modulus is a variable due to the draw-dependent change in shape of the cross-section of the bow.

FIGS. 3, 4 and 5 and the associated cross-sections show in exaggerated form that approach toward flatness (H approaches T) non-uniformly in sections of the limb. From FIG. 3 to FIG. 4 there is little change in cross-sectional curvature at sections A and B, while in section C, a substantial change occurs. From the condition in FIG. 4 to the condition of FIG. 5, while little change in cross-section occurs at section C, a substantial change occurs at sections A and B.

FIGS. 3, 4 and 5 also illustrate that a change in width W of the limb occurs in a preselected manner, by design. In the design of the illustration, from FIG. 3 to FIG. 4, $W_1$ and $W_2$, are substantially the same as $W_4$ and $W_5$, respectively, while width $W_6$ increases substantially as compared to $W_3$.

Having regard to FIGS. 4 and 5, while $W_6$ and $W_9$ are substantially the same, the dimensions $W_7$ and $W_8$ are substantially greater than dimensions $W_4$ and $W_5$, respectively.

FIG. 6 of the drawings illustrates various draw-pull relationships, both of prior art constructions J and of constructions embodying the principle of the present invention. Curve AB shows the relationship between pull force and draw distance of a conventional bow, illustrating that the specific pounds of pull force applied to a bowstring result in specific longitudinal deflections of the bow, the relationship being substantially linear. The energy that goes back into the bow on release of the bowstring is proportional to the area within the curve ABD less the amount of energy that goes back into the bow due to its moving mass, that is to say, less all of the energy that is used in movement to return the bow to its normal position.

In FIG. 6, curves AFB, AEB, AFC and AEG represent full-draw characteristics of bows utilizing the principles of the present invention. As pull force is applied to the bowstring, the relationship is shown to be non-linear and exhibit both positive and negative slopes. Considering the pull-draw characteristics illustrated by the curve AFB, to draw the bowstring 15 inches from normal requires a short duration "jerk" or pull force of 75 pounds, but the drawing of the bow further, beyond the 15 inches requires a reduced force. When the full deflection of 30 inches is reached, the aim resistance or pull force of only 60 pounds is required as is required for the illustrated conventional bow. However, the energy imparted to the bow with the design of the present invention is proportional to the area under the curve AFBD, again, minus the energy which is required to move the parts of the bow to normal position. Comparing the areas under the curve ABD of the conventional bow and AFBD of the bow of the present invention, it will be seen that both bows require a pull force of 60 pounds at a 30 inch draw but it can be appreciated that the bow of the present invention imparts approximately twice the amount of energy to the arrow upon release of the bowstring. It can also be appreciated from the curve AFB of FIG. 6 that the peak maximum resistance encountered occurs at point F which will be a position in which the arm or elbow of the archer is at a position of maximum leverage. The high resistance of point F can be passed over or overcome by a quick impulse or jerking action of the archer.

In FIG. 6 of the drawings, the variations in the characteristics illustrated by the curves AEG, AEB, AFC, and AFB, are obtained by adjusting the dimension of extent of curvature H and constructing the bow of such material that the dimension H will progressively approach the dimension of the thickness T at a different rate at different sections of the bow limb structure with increase of draw length.

The curve AFC may be obtained by modifying the bow construction and dimension H so as to cause one of the bow limb structure sections to approach flatness or rectangular cross-section in advance of others. That is, the dimension H will approach the dimension T at a greater rate in one of the sections A, B or C of the limb structure in advance of other sections.

The curve AEB may be obtained by design of the bow construction so that the the thickness T of the curved cross-section is less than that of the conventional bow ($T_1$ of FIG. 2*b*) and by increasing the dimension H so that it only approaches the dimension T at or near full draw of the bow, that is, at full draw H will equal approximately 130% of T over approximately 60% of the bow limb. The curve AEG can be obtained by combining the design criteria for obtaining curve AEB and the curve AFC.

FIG. 7 of the drawings illustrates the draw characteristics of two separate bows that are strung, there being a draw displacement of six inches at the static or zero draw condition. The curve AJB represents a conventional bow construction. The curve AKY represents a bow incorporating the inventive concept of the present invention. From the standpoint of economy in production, it is desirable to construct a bow that will accommodate a maximum variety of characteristics as demanded by the archer having regard to such considerations as body size, arm strength, arm length, and the like. Utilizing the concept of the present invention, it can be seen that the curve AKZY exhibits a nearly constant draw force from the point of 22 inches to a point of approximately 31 inches of bow draw. One method of providing this flattened characteristic can be obtained by a bow design whereby the thickness T of the bow at the distal section is greater than the thickness T of the bow at the proximal section, or that portion of the bow approaching the center. Also, this characteristic can be obtained by determining the dimension H such that H will approach T and the cross-section configuration will assume a nearly flattened or rectangular form at the outer extremity of the bow before this condition occurs at the inner portion of the bow. That is to say, the curved cross-section of the bow flattens progressively from one end toward the midpoint of the bow with the increase of draw distance, up to approximately three-quarters of full draw condition, at which point a near hinge effect is produced at the base of the bow for all additional draw. (H equals T for a short area of the base of the bow.)

As can be seen from the curve AKZY there is only approximately a two-pound pull force variation in a single bow construction from the draw condition of 24 inches, to approximately 30 inches. This has the very great advantage of enabling one single bow construction to accommodate the wide variety of demand of a large number of archers. In the illustration, the single bow will be appropriate for archers who require a full draw characteristic from 23 to 30 inches at a pull force of between 40 and 50 pounds. The advantage of this from the standpoint of supplying the market with a variety of bow characteristic design is obvious.

From the foregoing explanation, it can be seen that the primary variables determining the desired energy curve characteristics of an archery bow according to the present invention, are the dimension H, the dimension T, whether concave or convex, and the ratio of the dimension H at the outer ends of the bow as compared to the same dimension toward the middle or base of the bow construction. Drawing of the curved cross-section bow simultaneously causes the radius of longitudinal curvature to decrease and the cross-sectional curvature to increase. Variations in the operational characteristics can be obtained by design choice, whereby the flatness of cross-sectional configuration occurs progressively at different sections of the bow during the progression of the bow draw.

These variables may be adjusted to produce almost any shape of energy curve desired. A variety of techniques may be recognized by those skilled in the art as suitable for fabricating the limb structure shaped in accordance with the foregoing design considerations.

Additional curvature control and modification of a bow characteristic may be obtained by variation of the frontal width or back width of the bow construction, and also by introducing curved sides rather than straight parallel or tapered sides of the frontal shape of the bow.

Although this specification has been directed specifically to construction of archery bows and crossbows, the principle of the present invention is applicable to other uses where a non-linear relationship of force vs. deflection is desired. An example of another application is in golf club shafts, where a higher degree of stiffness of the shaft might be desired on a downswing as compared to a lesser degree of stiffness or more flexibility of shaft on the upswing.

An example of another application of the principle of the present invention is in fishing rods, where the degree of flexibility of the rod might be varied at the will of the angler by mere rotation of the rod by some degree, whereby flexibility of the rod can be varied to suit the condition encountered by the angler, or where it is desired to reduce the weight for a given flexibility and strength.

Other modifications will be obvious to those skilled in the art.

I claim:

1. In an archery bow of the type having a longitudinally curved body member which includes a central grip portion with outwardly extending limbs, and a string member joining the outer ends of said outwardly extending limbs, the improvement which comprises a limb structure having cross-sectional configurations that are curved in its transverse planes which are substantially perpendicular to its longitudinal axis, said cross-sectional configurations having predetermined dimensions of thickness and predetermined dimensions of extent of curvature which progressively vary at different sections of the limb structure, such that with increasing draw distance in the archery bow, the radius of longitudinal curvature of the limb structure decreases while said cross-sectional configurations increase in radius of curvature progressively and at different rates at different sections of the limb structure.

2. The improved archery bow of claim 1, wherein for a given predetermined dimension of thickness, the predetermined dimension of curvature approaches that of the thickness at a greater rate at particular sections of the limb structure and in advance of the other sections thereof, such that with increasing draw distance and the improved archery bow approaching full draw position, said cross-sectional configuration approaches a nearly rectangular form at said particular section in advance of other sections.

3. The improved archery bow of claim 1, wherein the predetermined dimension of the thickness at the distal section of the limb structure is greater than that of the other sections thereof and the predetermined dimension of curvature approaches that of the thickness at a greater rate at the distal section of the limb structure and in advance of the other sections thereof, such that with the improved archery bow draw distance approaching three-quarters of full draw condition, said cross-sectional configuration approaches a nearly rectangular form at the distal section of the limb structure in advance of the other section thereof, whereby the maximum draw force is used before full draw condition is reached and a reduced pull force is required while approaching and maintaining full draw position, which is conducive to effective aiming of the improved archery bow.

4. In an archery bow of the type having a longitudinally curved body member which includes a central grip portion with outwardly extending limbs, and a string member joining the outer ends of said outwardly extending limbs, the improvement which comprises a limb structure having cross-sectional configurations that are curved in its transverse planes which are substantially perpendicular to its longitudinal axis, said cross-sectional configurations having predetermined dimensions of thickness and predetermined dimensions of width, which progressively vary at different sections of the limb structure such that with increasing draw distance in the archery bow the radius of longitudinal curvature of the limb structure decreases while said cross-sectional configurations increase in radius of curvature and width at a different rate at different sections of the limb structure.

5. The improved archery bow of claim 4, wherein for a given predetermined dimension of thickness the predetermined dimension of W varies at a greater rate at a particular section of the limb structure and approaches its predetermined optimum at that particular section in advance of the others when the improved archery bow is approaching full draw condition.

* * * * *